US008376196B2

(12) United States Patent
Ebner et al.

(10) Patent No.: US 8,376,196 B2
(45) Date of Patent: Feb. 19, 2013

(54) APPARATUS FOR THE INTERCHANGEABLE CONNECTION OF A CASTING TUBE TO A SPOUT OF A MELT VESSEL

(75) Inventors: Helmut Ebner, Naarn i.M. (AT); Johann Penn, Altenberg (AT); Heinrich Thoene, Linz (AT); Franz Wimmer, Riedau (AT)

(73) Assignee: Siemens Vai Metals Technologies GmbH (AT)

( * ) Notice: Subject to any disclaimer, the term of this patent is extended or adjusted under 35 U.S.C. 154(b) by 435 days.

(21) Appl. No.: 12/808,401

(22) PCT Filed: Dec. 16, 2008

(86) PCT No.: PCT/EP2008/010725

§ 371 (c)(1),
(2), (4) Date: Jun. 16, 2010

(87) PCT Pub. No.: WO2009/080257

PCT Pub. Date: Jul. 2, 2009

(65) Prior Publication Data

US 2010/0314421 A1 Dec. 16, 2010

(30) Foreign Application Priority Data

Dec. 20, 2007 (AT) ..... A 2078/2007

(51) Int. Cl.
*B22D 41/50* (2006.01)

(52) U.S. Cl. ..... 222/591; 266/236

(58) Field of Classification Search ..... 222/591; 266/236

See application file for complete search history.

(56) References Cited

U.S. PATENT DOCUMENTS

| | | | |
|---|---|---|---|
| 4,526,301 | A | 7/1985 | King et al. |
| 4,526,304 | A | 7/1985 | Nishimura |
| 4,892,235 | A | 1/1990 | King |
| 5,961,873 | A | 10/1999 | Keller |
| 7,171,326 | B2 | 1/2007 | Gerber et al. |

FOREIGN PATENT DOCUMENTS

| | | | |
|---|---|---|---|
| AT | 349 666 | B | 4/1979 |
| DE | 3506427 | A1 | 9/1986 |
| EP | 0 577 909 | A | 1/1994 |
| EP | 0 820 825 | A | 1/1998 |
| EP | 0 891 829 | A | 1/1999 |
| EP | 1486272 | B1 | 3/2006 |
| EP | 1486271 | B1 | 7/2008 |

(Continued)

OTHER PUBLICATIONS

International Search Report dated Mar. 17, 2009, issued in corresponding international application No. PCT/EP2008/010725.

*Primary Examiner* — Lois Zheng
(74) *Attorney, Agent, or Firm* — Ostrolenk Faber LLP

(57) ABSTRACT

A device for interchangeable connection of a casting tube to a spout of a melt vessel with a sliding closure fastened on a melt vessel. The closure is formed by at least one stationary closure plate and a closure plate that can be displaced relative thereto, wherein the displaceable closure plate is coupled to a sliding drive system and carries the casting tube. To improve the changeover process of a casting tube and to make it safer, the displaceable closure plate carries a connecting ring for the centered accommodation of the casting tube and the displaceable closure plate carries a changing device for the casting tube. The changing device is synchronously displaceable with the displaceable plate. A tensioning device presses the casting tube onto the displaceable closure plate.

17 Claims, 4 Drawing Sheets

FOREIGN PATENT DOCUMENTS

| | | | |
|---|---|---|---|
| GB | 2171348 | A | 8/1986 |
| JP | 61-172660 | A | 8/1986 |
| JP | 04-083453 | U | 7/1992 |
| JP | 05-318061 | A | 12/1993 |
| JP | 07-016739 | A | 1/1995 |
| JP | 10-058124 | A | 3/1998 |
| JP | 10-211570 | A | 8/1998 |
| JP | 2002-035926 | A | 2/2002 |
| WO | WO 03/080274 | A | 10/2003 |

APPARATUS FOR THE INTERCHANGEABLE CONNECTION OF A CASTING TUBE TO A SPOUT OF A MELT VESSEL

CROSS-REFERENCE TO RELATED APPLICATIONS

The present application is a 35 U.S.C. §§371 national phase conversion of PCT/EP2008/010725, filed Dec. 16, 2008, which claims priority of Austrian Application No. A2078/2007, filed Dec. 20, 2007, the contents of which are incorporated by reference herein. The PCT International Application was published in the German language.

BACKGROUND OF THE INVENTION

1. Technical Field

The invention relates to an apparatus for the interchangeable connection of a casting tube to a spout of a melt vessel, having a slide closure which is fastened to the melt vessel and is formed by at least one stationary closure plate and a closure plate which is displaceable in relation thereto, wherein the displaceable closure plate is coupled to a displacement drive and bears the casting tube.

2. Prior Art

A slide closure of the generic type is already known, for example, from WO 03/080274. This slide closure is in the form of a two-plate slide, where a movable closure plate can be displaced using a hydraulic actuator between an "open position", which allows molten metal to pass through, and a "closed position", which blocks the passage through.

JP 5-318061 discloses a compact subassembly comprising a two-plate slide and a casting tube, which is braced in the operating position by a clamping device and can be released for a joint installation or removal operation.

Slide closures are used, in particular, in continuous casting installations either on the casting ladle or, in particular, on the transfer vessel, in order to ensure a regulated inflow of molten metal into the continuous casting mold and thus a stable casting operation. Refractory closure plate inserts and the casting tubes or shrouds are parts which become worn and often have to be changed. Before the start of the casting operation, the spouts of the melt vessels are closed and have to be opened using special measures. This requires easy and safe manipulation of, for example, a firing device in a hazardous environment for operating personnel.

A series of solutions have already been developed in order to fix a casting tube or shroud firstly in its operating position on the slide closure and to press it onto said slide closure with a specific contact pressure, and secondly in order to be able to change the casting tube.

By way of example, EP 577 909 A1 discloses a mechanism for supporting a casting tube on, and pressing it onto, an outlet of a tundish, wherein the support device comprises a two-arm lever which is pivotable about an external axis of rotation, one end of this lever being provided with a mounting ring for the casting tube and the opposite end being provided with a counterweight for producing a contact pressure on the casting tube. In this design, however, the casting nozzle can be accurately positioned with respect to the outlet opening for the molten metal only by means of an independently displaceable, but therefore dirt-prone, auxiliary nozzle.

U.S. Pat. No. 4,892,235 discloses a support and pressure-exerting apparatus for a casting nozzle, by means of which apparatus the casting tube can be pressed onto a stationary closure plate of a three-plate slide. A fork mount for the casting tube, which can be pivoted in and out about a vertical axis, comprises support bars, which are in the form of spring elements and can be used to produce a substantially predetermined contact pressure after a securing stop has been pivoted in. A series of manipulations have to be carried out manually here to make it possible to change the casting tube, as a result of which the safety of the operating personnel is significantly impaired.

U.S. Pat. No. 4,526,301, EP 891 829 A1, EP 820 825 A1 and AT 349 666 B already disclose changeover devices for casting tubes in conjunction with a three-plate slide, in which the displaceable closure plate is arranged between two stationary closure plates and the casting tube is assigned to one of the stationary closure plates.

Furthermore, the changeover devices described are not suitable for casting tubes and shrouds for use in two-plate slides where the casting tube or shroud is to be fastened to the movable closure plate.

SUMMARY OF THE INVENTION

It is therefore an object of the present invention to improve an apparatus for the interchangeable connection of a casting tube to a spout of a melt vessel to such an extent that it is also possible to carry out simple manipulation of the casting nozzle during a casting nozzle change or any other manipulation required in an automated manner, and positionally accurate docking of a casting tube onto a displaceable closure plate of a two-plate slide is reliably ensured.

In the case of an apparatus for the interchangeable connection of a casting tube to a spout of a melt vessel of the type described in the introduction, this object is achieved in that the displaceable closure plate bears a connection ring for the centered mounting of the casting tube, and the displaceable closure plate bears a changeover device, which is displaceable synchronously with said plate, for the casting tube and a clamping device for pressing the casting tube onto the displaceable closure plate.

The displaceable closure plate consists essentially of a closure plate frame which receives a closure plate insert, which is made from a refractory material and has a passage opening for the liquid metal, in a recess. The closure plate frame is guided so that it can move horizontally in a support frame of the slide closure and is coupled to a displacement drive, which is fastened to the support frame of the slide closure. Accurate positioning of the casting tube, irrespective of the current position of the displaceable closure plate, is reliably ensured by the fastening of the changeover device for the casting tube and, depending on the embodiment, also an arbitrary clamping device for pressing the casting tube onto said closure plate, specifically onto the closure plate frame of the closure plate. The displaceable closure plate may be situated both in an "open position", which allows molten metal to pass through, and in a "closed position", which blocks the molten metal from passing through.

According to a preferred embodiment, the changeover device comprises a pivot shaft and a pivot drive connected to the pivot shaft. The pivot shaft is supported on the displaceable closure plate, which permits a pivoting movement about its pivot axis. Furthermore, a mounting fork for the mounting of the casting tube is fixedly connected to the pivot shaft, and the two fork arms of the mounting fork are arranged in parallel planes normal to the pivot axis. As a result, the casting tube can be pivoted completely out of the region of the closure plate insert by way of a rotational movement in the case of short fork arms, and the closure plate insert is thereby accessible. By way of example, in this pivoted-out position of the casting tube, a blocked liquid metal duct can easily be unblocked using an oxygen lance moved by a manipulator or robot.

A geometrically expedient arrangement of the changeover device on the displaceable closure plate or the closure plate frame is provided if the pivot axis of the pivot shaft is arranged at a lateral distance from the connection ring for the casting tube, and the casting tube docking onto the connection ring locates a connection position on the slide closure, and if, in relation to a vertical plane incorporating the pivot axis, the connection position of the casting tube is located on one side of the vertical plane and a changeover position for the casting tube is located on the opposing, remote side of the vertical plane or directly in this vertical plane.

A changeover device having the design described allows the casting tube to be displaced between a connection position on the displaceable closure plate and a changeover position of the casting tube about a pivot axis in a pivot angle range of between 90° and 180°. This pivoting-out movement moves the casting nozzle into a region which is readily accessible to a manipulator, and therefore it is possible, given a correspondingly favorable refinement of the mounting hook at the ends of the fork arms, both to manage the large pivot angle without any problems and also to easily perform automated unloading and loading of the changeover device by means of a robot.

In order to be able to change the casting tube in an automated manner using a robot or another manipulator, the casting tube is equipped with a support ring and inserted together with the latter into the pivot device. Here, the support ring has a ring element which is matched to the outside diameter of the casting tube and in which the casting tube is positioned, the ring element being adjoined by opposing support pins which are directed away from one another and lie in mounting forks of the two fork arms of the pivot device, and a coupling apparatus for the gripping tool of a robot being arranged on the ring element. The coupling apparatus is expediently positioned at an angle of 90° in relation to the support pins on the ring element.

After the casting tube has been pivoted from the connection position into the changeover position, the robot can therefore easily grasp a casting tube to be changed with the coupling apparatus of the support ring directed counter to it, and dock thereon. The robot then threads the casting tube out of the pivot device and sets the casting tube down in a tool store. The robot takes hold of a casting tube, prepared for the next use, from the tool store using its gripping tool on the coupling apparatus of the support ring and hangs the casting tube in the mounting forks of the changeover device, which wait in the changeover position. The casting tube is then pivoted back into the connection position by way of a pivoting movement, and is ready for use.

The pivot drive is preferably formed by an oscillating motor. Oscillating motors make it possible to accurately set the angle of rotation of the pivot shaft and thus to precisely control the connection position, the changeover position and intermediate positions of the casting tube which may be necessary.

It is preferred to use a hydraulic oscillating motor. However, it is equally possible to also use oscillating motors with a pneumatic or electric drive. The preferably hydraulic oscillating motor comprises a linear cylinder and a mechanism for producing a pivoting movement of the changeover device under predetermined pivot conditions.

The clamping device for pressing the casting tube onto the connection ring is expediently fastened with a predetermined contact pressure to the displaceable closure plate.

Alternatively, it is also possible for the clamping device for pressing the casting tube onto the connection ring to be integrated directly in the changeover device, in particular the pivot drive.

The clamping device is preferably assigned a regulating device for the regulated setting of a predetermined contact pressure.

If the clamping device is integrated directly in the hydraulic oscillating motor or is part of the hydraulic oscillating motor, the regulated contact pressure is set using the hydraulic devices of the oscillating motor. In this case, the clamping apparatus is arranged only indirectly on the displaceable closure plate or the closure plate frame.

The clamping device can also be formed by a pretensioned spring which acts on the pivot shaft of the pivot device. The pretensioned spring can be formed by a mechanical spring of any desired design, e.g. a torsion spring, a pneumatic or hydraulic spring element.

During metallurgical operation, the melt vessel closed by way of a slide closure and filled with molten metal, provided that said vessel is a casting ladle, mostly passes through a plurality of treatment stages, during which the molten metal is alloyed or subjected to a metallurgical refining operation, for example. In this context, no further components apart from the slide closure itself should be fastened to the bottom of the vessel, above all no hydraulic control devices. In order to be able to achieve this in the case of the changeover device according to the invention as well, the changeover device comprises, subdivisible into divisible subassemblies, a pivot shaft and a pivot drive which can automatically be coupled to the pivot shaft during an insertion movement. At least one centering lug for the mounting and positioning of the pivot drive is arranged on the displaceable closure plate or specifically on the displaceable closure plate frame. The insertion and coupling of the pivot drive onto the pivot shaft expediently takes place using a robot.

The same possibility also exists for the pivot shaft, which can be inserted, positioned and locked together with its bearings in mounting pockets on the displaceable closure plate or the displaceable closure plate frame. In this case too, the insertion expediently takes place using a robot.

In order to make these automated assembly operations easier, the pivot drive and, if appropriate, also the pivot shaft are equipped with a coupling apparatus for a gripping tool of a robot. It is therefore easy to pick up these subassemblies from, or set them down on, a prepared support bracket. It is therefore also possible, without the intervention of personnel in a potentially hazardous area, for the pivot drive and/or the pivot shaft to be set down on a support bracket during individual pretreatment steps and during transportation of the melt vessel, during metallurgical operation, separately from the displaceable closure plate or the displaceable closure plate frame on a support frame which determines the casting position, and for the pivot drive and/or the pivot shaft to be inserted using a robot or another manipulator on the displaceable closure plate or the displaceable closure plate frame only after the melt vessel has been set down on the support frame.

For the specific application in a continuous casting installation, the melt vessel forms a casting ladle which is used to move pretreated molten steel from the steelworks to the continuous casting installation. The support frame for holding the casting ladle forms the ladle turning tower with its fork arms. The support bracket is also located on the ladle turning tower, and the pivot drive and the pivot shaft for the robot-assisted assembly on the slide closure are prepared on said bracket.

BRIEF DESCRIPTION OF THE DRAWINGS

Further advantages and features of the present invention are apparent from the following description of non-limiting exemplary embodiments, reference being made to the following figures.

EMBODIMENT OF THE INVENTION

The apparatus according to the invention for the interchangeable connection of a casting tube to a spout of a melt vessel is shown schematically in a number of views in FIGS. 1 to 4, and is explained in detail below with reference to this exemplary embodiment.

On the spout side, reference is usually made to casting tubes or immersion casting tubes in the case of transfer vessels in continuous casting plants, and, in the case of casting ladles, reference is usually made to shrouds. The solution according to the invention encompasses both applications and is equally suitable for both applications.

Figure 3:
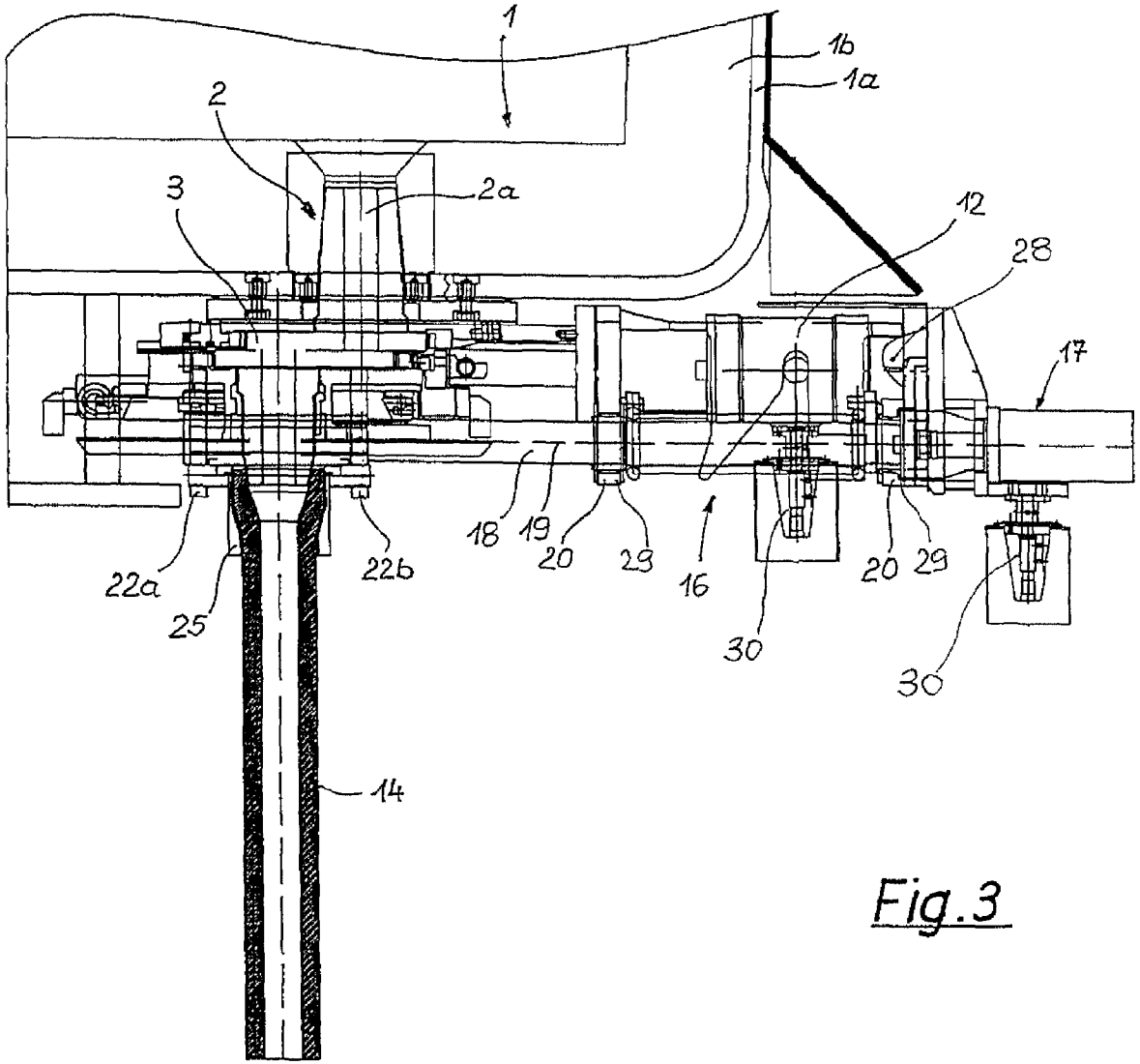
FIG. 3 shows a side view of an apparatus according to the invention for the interchangeable connection of a casting tube to the spout of a melt vessel.

FIG. 3 shows a partial section of a melt vessel 1, having a steel casing 1*a* and a refractory lining 1*b* on the inside. By way of example, the melt vessel can be in the form of a casting ladle or a tundish on a continuous casting installation. The bottom of the melt vessel is provided with a spout 2 which is made from refractory material and has an outlet opening 2*a* for molten metal (e.g. liquid steel) to continuously flow out. A closure element in the form of a slide closure 3 is arranged on the outside of the melt vessel, and this element can be used to close or open the outlet opening 2*a* or to regulate the amount of molten metal flowing through.

Figure 2:
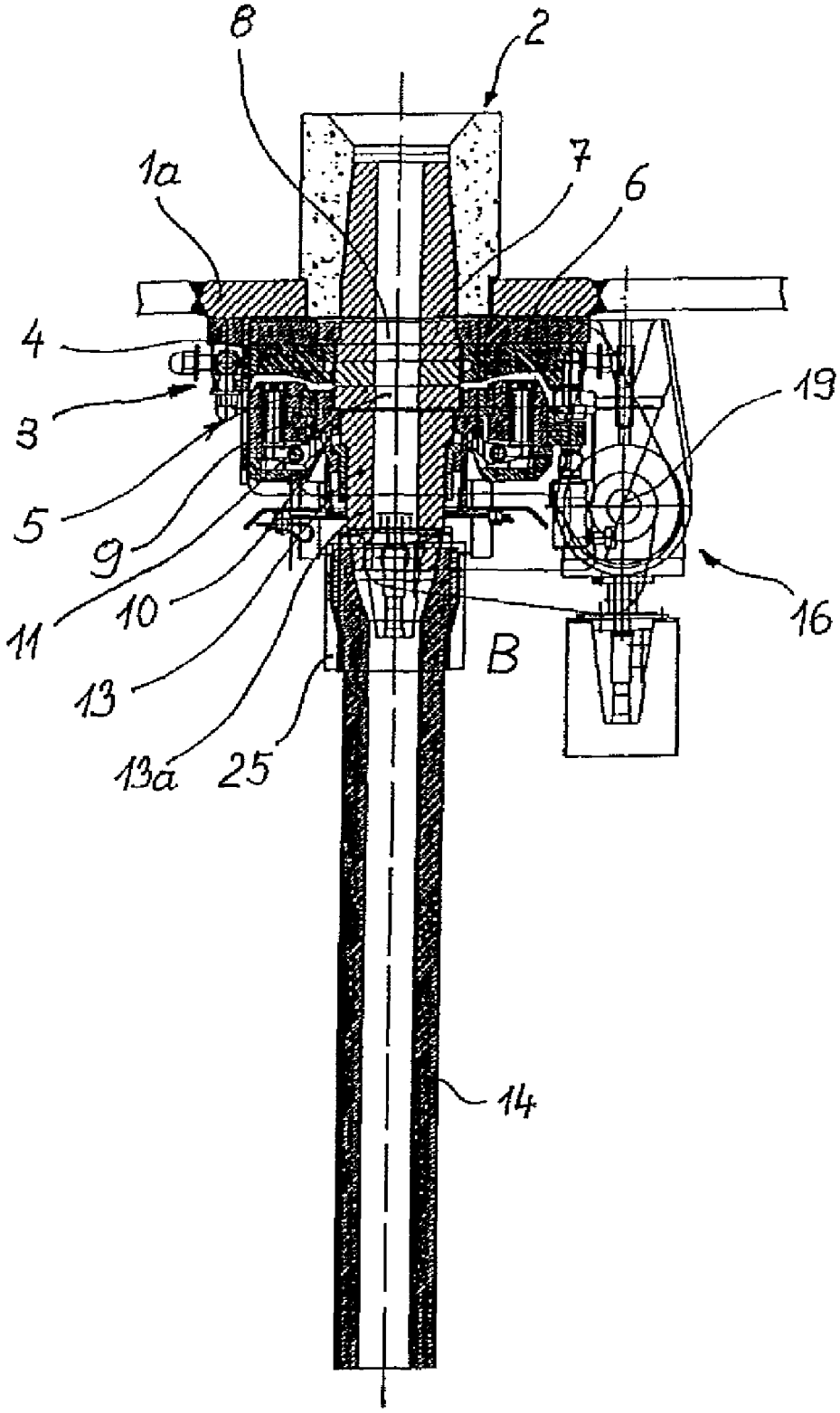
FIG. 2 shows an apparatus according to the invention for the interchangeable connection of a casting tube to the spout of a melt vessel in the connection position of the casting tube.

In FIG. 2, the slide closure 3 is in the form of a two-plate slide. The slide closure comprises—considered in functional terms—a stationary closure plate 4 and a displaceable closure plate 5. Within the context of the invention, both the stationary closure plate and the displaceable closure plate can comprise a plurality of parts, e.g. they can each comprise a plurality of closure plates which lie one on top of another.

The stationary closure plate 4 comprises a closure plate frame 6, which is fastened directly to the steel casing 1*a* of the melt vessel 1 by means of a screwed connection. A refractory closure plate insert 7 is inserted into the closure plate frame 6 and has a passage opening 8, which is aligned with the outlet opening 2*a* in the melt vessel 1. The displaceable closure plate rests on the stationary closure plate 4 and likewise comprises a closure plate frame 9, which is arranged such that it can be displaced on horizontal guides (not shown in more detail) of the stationary closure plate 4 between two control positions. A closure plate insert 10 is inserted into the movable closure plate frame 9 and supported therein, and this closure plate insert has a passage opening 11 which is aligned with the passage opening 8 in the closure plate insert 7 in one of the two control positions, and blocks the passage opening 11 in the other control position. The displaceable closure plate 5 is connected in an articulated manner to a hydraulic actuator 12, for example a controllable pressure-medium cylinder, the actuator 12 being supported on the stationary closure plate frame 6 and displacing the displaceable closure plate 5 between the two control positions.

The closure plate insert 10 of the displaceable closure plate 5 has a connection ring 13, which may be part of the closure plate insert 10 or else is also assigned to the displaceable closure plate 5 as a separate, casting-nozzle-like component 13*a*, as shown in FIG. 2. This connection ring 13 or the casting-nozzle-like component 13*a* serves to mount the casting tube 14 and to center it in a conical receiving seat.

For the manipulation of the casting tube 14, preferably to change it owing to wear, provision is made of a changeover device 16 which can be used to transport the casting tube 14 from a changeover position A to a connection position B and back again. The changeover device 16 is fastened entirely in a stationary manner on the closure plate frame 9 of the displaceable closure plate 5, and can therefore be displaced synchronously with said closure plate. This results in a major advantage of a changeover device 16 positioned in this way on the movable closure plate 5. The relative transport path for the manipulation of the casting tube always remains the same irrespective of the current position of the displaceable closure plate (open or closed position), and the centered positioning of the casting tube on the connection ring 13 is always reliably ensured and can easily be carried out (FIGS. 1 and 2).

Figure 1:
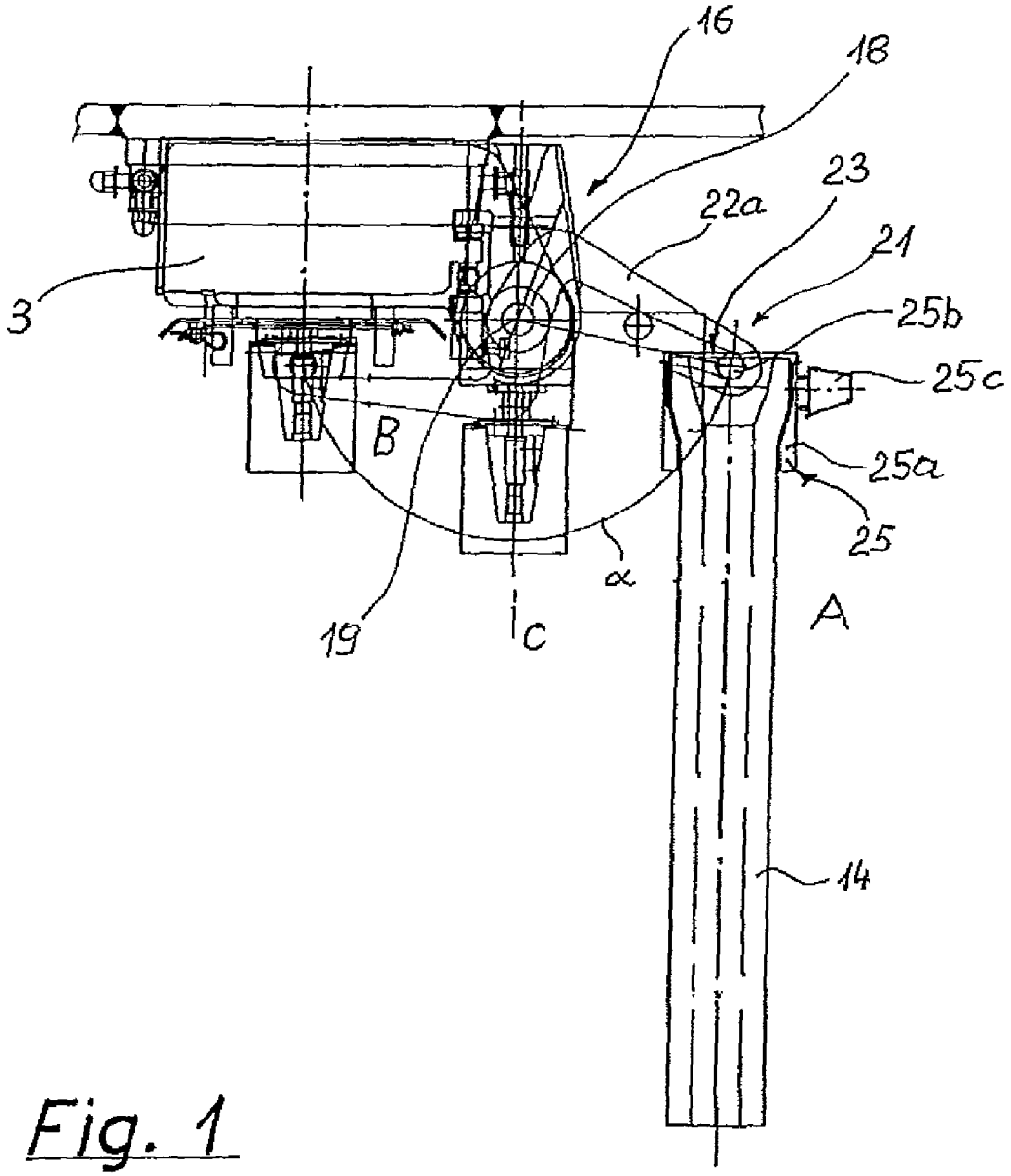
FIG. 1 shows an apparatus according to the invention for the interchangeable connection of a casting tube to the spout of a melt vessel in the changeover position of the casting tube.
Figure 4:
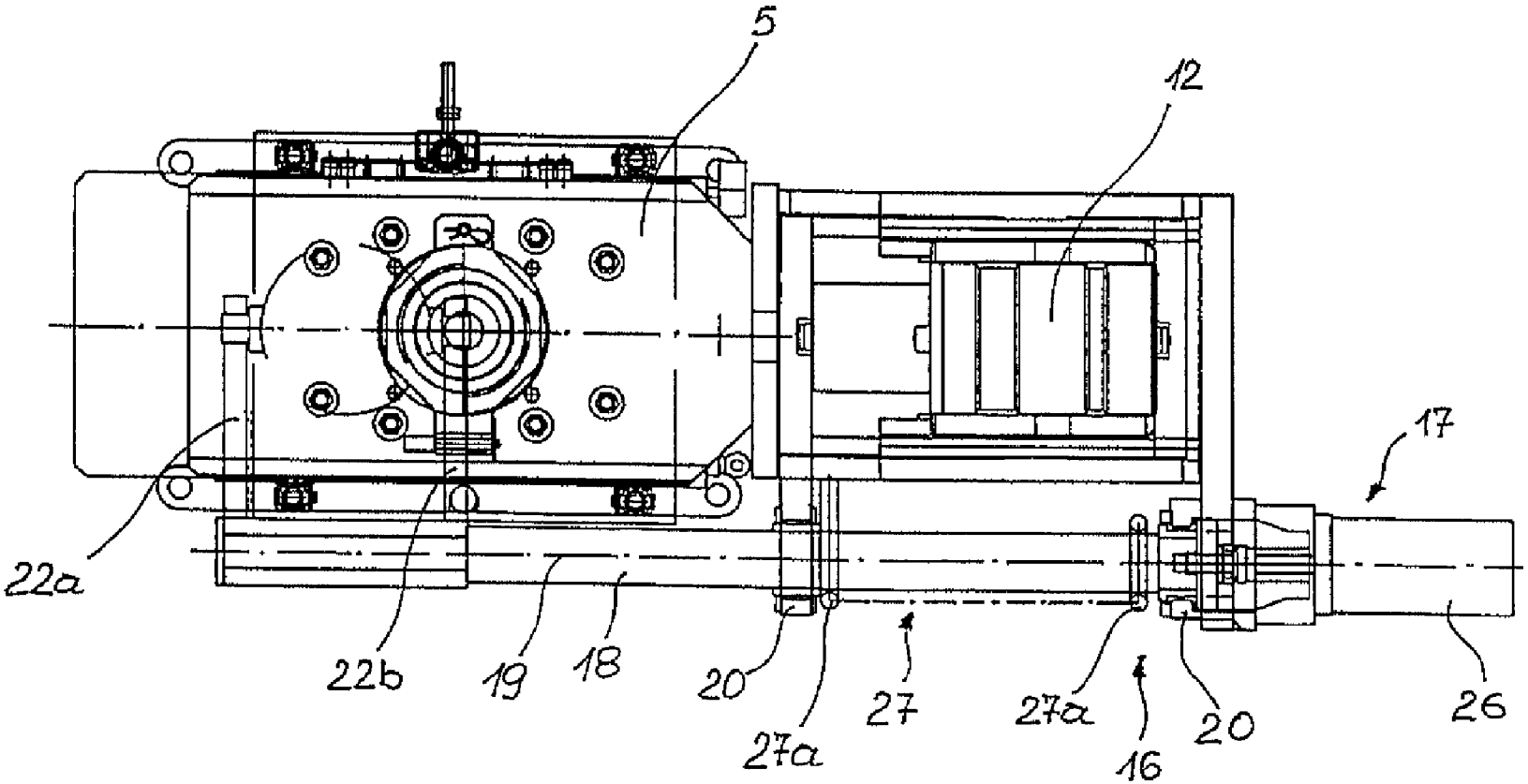
FIG. 4 shows a view from below an apparatus according to the invention for the interchangeable connection of a casting tube to the spout of a melt vessel.

As can be gathered from FIGS. 1, 3 and 4, the changeover device 16 comprises a pivot drive 17 and a pivot shaft 18. The pivot shaft 18 is coupled directly to the motor-driven pivot drive 17 and rotatably supported on the displaceable closure plate 5 via bearings 20—so as to permit a pivoting movement about its pivot axis 19. The free end of the pivot shaft 18 leads into a mounting fork 21 having two fork arms 22*a*, 22*b* for mounting the casting tube 14, the fork arms being arranged at a distance from one another in parallel planes normal to the pivot axis 19. The distance between the fork arms 22*a*, 22*b* is dependent on the outside diameter of the casting tube 14. The fork arms 22*a*, 22*b* extend in the manner of a hook and form mounting pockets 23 for mounting the casting tube 14. Here, the mounting pockets 23 are formed in such a manner that the casting tube 14 cannot slip out of the mounting pockets throughout the pivoting movement between the setting position B and the changeover position A and back again, and that the transfer of a contact pressure from the casting tube 14 onto the connection ring 13 is reliably ensured specifically in the setting position A.

The changeover device 16, with its pivot shaft 18 and pivot axis 19, is arranged laterally next to the slide closure 3 and the connection ring 13. With respect to a vertical plane C incorporating the pivot axis 19, the connection position B of the casting tube is located on one side of the vertical plane and a changeover position A for the casting tube is located on the opposing, remote side of the vertical plane C or directly in this vertical plane. The pivot axis 19 is oriented parallel to the direction in which the displaceable closure plate 5 is displaced. Relatively short fork arms 22*a*, 22*b* can be used to move the casting tube 14 from the connection position B into the relatively easily accessible changeover position A, in which the casting tube can easily be removed from the mounting pockets 23 of the fork arms and a replacement casting tube can be reinserted using a manipulator or a robot (not shown here). Furthermore, the spout region is made readily accessible for cleaning work, e.g. firing of the outlet opening using an oxygen blowing lance, which is likewise moved by a robot or another manipulator, or another device for opening or cleaning the outlet opening. The pivot angle range a between the mounting position B and the changeover position A is about 180°.

The casting tube 14 is pushed into a support ring 25 and inserted together with the latter into the two mounting pockets 23 of the fork arms 22*a*, 22*b*. It comprises a ring element 25*a* with a conical receiving seat, which corresponds to a conical ring part in the upper region of the casting tube 14. The ring element 25*a* is adjoined by opposing support pins 25*b* which are directed away from one another and lie in the mounting pockets 23 of the changeover device 16. Furthermore, the ring element comprises a coupling apparatus 25*c*, which can be used to establish a grip connection to a robot or manipulator.

The pivot drive 17 is formed by an oscillating motor 26, which is preferably hydraulically operated. This makes it possible to directly convert a hydraulically produced movement of a linear cylinder, by means of a mechanism, into a dosed rotational movement of the pivot shaft 18. The hydraulic oscillating motor also makes it possible to set a regulated contact pressure and to retain this contact pressure over a casting cycle by way of a clamping apparatus 27 integrated therein.

A clamping device 27 for the targeted pressing of the casting tube onto the displaceable closure plate can also be provided, for example, by the action of a pretensioned spring 27*a*, which acts directly on the pivot shaft. This pretensionable spring is in the form of a torsion spring in FIG. 4, reaches around the pivot shaft 18, is fixed on the latter and on the displaceable closure plate 5, or on the closure plate frame 9, and builds up a corresponding contact pressure during the pivoting movement into the connection position B.

The pivot drive 17 and the displaceable closure plate 5 are assigned centering lugs 28, which make the automated insertion and coupling or else removal of the pivot drive into and from its operating position possible using a robot (not shown in FIG. 3). Similarly, the bearings 20 assigned to the pivot shaft 18 are arranged in mounting pockets 29 in such a manner that robot-assisted insertion and locking in the operating position is likewise possible. The pivot drive 17 and the pivot shaft 18 are designed as a subassembly and are prepared for assembly on a support bracket (not shown here) placed close to the site of use on the support frame of the melt vessel. The pivot drive 17 and the pivot shaft 18 are equipped with coupling apparatuses 30 for coupling to a gripping tool of a robot.

LIST OF REFERENCE SYMBOLS

1 Melt vessel
1*a* Steel casing of the melt vessel
1*b* Refractory lining of the melt vessel
2 Spout
2*a* Outlet opening for molten metal
3 Slide closure
4 Stationary closure plate
5 Displaceable closure plate
6 Closure plate frame of the stationary closure plate 4
7 Closure plate insert
8 Passage opening
9 Closure plate frame of the displaceable closure plate 5
10 Closure plate insert
11 Passage opening in the closure plate insert
12 Displacement drive
13 Connection ring
13*a* Connection ring as casting-nozzle-like component
14 Casting tube
16 Changeover device
17 Pivot drive
18 Pivot shaft
19 Pivot axis
20 Bearing
21 Mounting fork
22*a*,22*b* Fork arms
23 Mounting pocket
25 Support ring
25*a* Ring element
25*b* Support pin
25*c* Coupling apparatus
26 Oscillating motor
27 Clamping device
27*a* Spring
28 Centering lug
29 Mounting pockets
30 Coupling apparatus
A Changeover position
B Connection position
C Vertical plane
α Pivot angle range

The invention claimed is:

1. Apparatus for the interchangeable connection of a casting tube to a spout of a melt vessel, comprising:

a slide closure fastened to the melt vessel, the slide closure comprising at least one stationary closure plate and a displaceable closure plate which is displaceable in relation to the stationary closure plate; the displaceable closure plate supporting the casting tube;

a displacement drive coupled to the displaceable closure plate;

a connection ring supported by the displaceable closure plate, the displaceable closure plate configured for centered mounting of the casting tube, the connection ring supported on the displaceable closure plate supporting the casting tube;

a changeover device for the casting tube supported on the displaceable closure plate, the changeover device is displaceable synchronously with the displaceable closure plate;

a clamping device configured for pressing the casting tube onto the displaceable closure plate;

the changeover device comprising a pivot shaft and a pivot drive connected to the pivot shaft to cause it to pivot, the pivot shaft being supported on the displaceable closure plate so as to permit pivoting of the pivot shaft about a pivot axis thereof.

2. The apparatus as claimed in claim 1, wherein the pivot axis of the pivot shaft is arranged at a lateral distance from the connection ring for the casting tube, the casting tube docking onto the connection ring and locating a connection position on the slide closure, wherein in relation to a vertical plane incorporating the pivot axis, the connection position of the casting tube is located on one side of the vertical plane and a changeover position for the casting tube is located on the opposite, remote side of the vertical plane or directly in the vertical plane.

3. The apparatus as claimed in claim 1, wherein the changeover device is configured to allow the casting tube to be displaced between a connection position on the displaceable closure plate and a changeover position of the casting tube about a pivot axis in a pivot angle range (α) of between 90° and 180°.

4. The apparatus as claimed in claim 1, further comprising a mounting fork configured for mounting the casting tube on the fork, the fork is fixedly connected to the pivot shaft' the mounting fork having two fork arms arranged in respective parallel planes normal to the pivot axis.

5. The apparatus as claimed in claim 1, further comprising a mounting fork configured for mounting the casting tube on the fork, the fork is fixedly connected to the pivot shaft' the mounting fork having two fork arms arranged in respective parallel planes normal to the pivot axis, the casting tube together with a second support ring is inserted into the changeover device, the second support ring having a ring element which is matched to an outside diameter of the casting tube and the casting tube is positioned in the ring element, by opposing support pins which adjoin the ring element and are directed away from one another and lying in mounting forks of the two fork arms of the changeover device; and a coupling apparatus for a gripping tool of a robot arranged on the ring element.

6. The apparatus as claimed in claim 1, wherein the pivot drive is comprised of an oscillating motor.

7. The apparatus as claimed in claim 6, wherein the oscillating motor comprises a linear cylinder and a mechanism for producing pivoting movement.

8. The apparatus as claimed in claim 6, wherein the oscillating motor is one of a hydraulically, pneumatically or electrically operated oscillating motor.

9. The apparatus as claimed in claim 6, wherein the oscillating motor comprises a hydraulic oscillating motor in which the clamping device is integrated, and a regulated contact pressure is set using hydraulic devices of the oscillating motor.

10. The apparatus as claimed in claim 1, wherein the clamping device for pressing the casting tube onto the connection ring is fastened with a predetermined contact pressure to the displaceable closure plate, or is integrated directly in the changeover device.

11. The apparatus as claimed in claim 10, further comprising a regulating device for regulated setting of a predetermined contact pressure of the clamping device.

12. The apparatus as claimed in claim 10, wherein the clamping device comprises a pretensioned spring which acts on the pivot shaft of the changeover device.

13. The apparatus as claimed in claim 1, wherein the displaceable closure plate comprises a displaceable closure plate frame and a refractory closure plate insert which is configured to be inserted into the closure plate frame, and the pivot drive and, optionally, the clamping device are fastened to the displaceable closure plate frame.

14. The apparatus as claimed in claim 13, wherein the pivot drive is configured to automatically be coupled to the pivot shaft during an insertion movement; and at least one centering lug for mounting and positioning of the pivot drive being arranged on the displaceable closure plate or on the displaceable closure plate frame.

15. The apparatus as claimed in claim 14, further comprising the pivot shaft together with bearings for the shaft are inserted and positioned in mounting pockets on the displaceable closure plate or the displaceable closure plate frame.

16. The apparatus as claimed in claim 14, further comprising at least one of the pivot drive and the pivot shaft has a coupling apparatus for a gripping tool of a robot.

17. The apparatus as claimed in claim 14, wherein at least one of the pivot drive and the pivot shaft is configured to be set down on a support bracket during individual pretreatment steps and during transportation of the melt vessel, during metallurgical operation, separately from the displaceable closure plate or the displaceable closure plate frame on a support frame which determines a casting position, and at least one of the pivot drive and the pivot shaft is inserted using a robot or another manipulator on the displaceable closure plate or the displaceable closure plate frame after the melt vessel has been set down on the support frame.

* * * * *